US007927055B2

(12) United States Patent
Brommer et al.

(10) Patent No.: US 7,927,055 B2
(45) **Date of Patent: *Apr. 19, 2011**

(54) BINDING-IN MACHINE WITH BOOK FEED

(75) Inventors: Carsten Brommer, Tecklenburg/Leeden (DE); Manfred Albrecht, Luebbecke (DE)

(73) Assignee: Kolbus GmbH & Co. KG, Rahden (DE)

( * ) Notice: Subject to any disclaimer, the term of this patent is extended or adjusted under 35 U.S.C. 154(b) by 733 days.

This patent is subject to a terminal disclaimer.

(21) Appl. No.: 11/999,189

(22) Filed: Dec. 4, 2007

(65) Prior Publication Data

US 2008/0138173 A1 Jun. 12, 2008

(30) Foreign Application Priority Data

Dec. 9, 2006 (DE) ..... 10 2006 058 090

(51) Int. Cl.
*B42C 11/02* (2006.01)

(52) U.S. Cl. ..... 412/19

(58) Field of Classification Search ..... 412/22, 412/21, 19, 5

See application file for complete search history.

(56) References Cited

U.S. PATENT DOCUMENTS

| | | | | |
|---|---|---|---|---|
| 2,921,322 | A | 1/1960 | Crawley | |
| 5,141,377 | A * | 8/1992 | Rathert | 412/22 |
| 2006/0140742 | A1 * | 6/2006 | Brommer et al. | 412/22 |

FOREIGN PATENT DOCUMENTS

| | | | |
|---|---|---|---|
| DE | 39 05 767 | A1 | 8/1990 |
| DE | 3905767 | A1 | 8/1990 |
| DE | 44 22 783 | A1 | 1/1996 |
| DE | 4422783 | A1 | 1/1996 |
| DE | 10200406 1995 | A1 | 7/2006 |
| DE | 102004061995 | A1 | 7/2006 |

* cited by examiner

*Primary Examiner* — Dana Ross
*Assistant Examiner* — Matthew G Katcoff
(74) *Attorney, Agent, or Firm* — Alix, Yale & Ristas, LLP

(57) ABSTRACT

The invention pertains to a binding-in machine (40) for pressing in and joint forming books (1) which comprises a multitude of pressing devices (1) and assigned joint forming devices (42), as well as devices for feeding the books (1) and aligning the cased book blocks (2) relative to the cases (3) and for post-forming the rounded book blocks, wherein a forming rail (43.5) is provided that acts upon the fore edge cut (1*b*) of the book block, and wherein the book is supported on the spine (1*a*) and/or in the case joints (1*c*). The books are laterally taken hold of by means of a book gripper (30.1 or 30.2) that moves back and forward and transfers the vertically positioned books from an upstream transfer position (20.11 or 20.12) between the opened pressing plates (41.1) of a pressing device (41), wherein the books are deposited on an alignment table (43.1) with their spine (1*a*) in order to subsequently align and post-form the books (1) within the pressing device (41). A pre-formed book is gently transferred into the pressing device such that its form is preserved.

19 Claims, 4 Drawing Sheets

BINDING-IN MACHINE WITH BOOK FEED

BACKGROUND

The invention pertains to a binding-in machine for pressing in and joint forming books.

DE 39 05 767 A1 discloses a binding-in machine with a multitude of pressing devices that are continuously driven along a closed oval-shaped circulation path, as well as joint forming devices that are arranged on the pressing devices. The book blocks that are cased into cases are supplied on a straight section of the transport system and the delivery of the formed and pressed books takes place on the opposite straight section. During the transport between the infeed and the delivery, the books are permanently held in the pressing devices such that the entire transport time is available for the full surface pressing and joint forming processes. In this case, the full surface of the books up to the case joints is accommodated in the pressing devices.

The books are transported between the opened pressing plates obliquely upward by means of a transfer device that briefly moves synchronous with the pressing devices. A post-forming of the rounded book block and an alignment of the cased-in book block relative to the case is not carried out within the pressing device. Instead, pre-formed books should be fed to the pressing devices while they are clamped in the transfer device. However, these pre-formed book blocks cannot remain fixed until they are clamped by the pressing plates that laterally act upon the books over the entire surface such that it is possible for restoring forces to neutralize the already realized pre-forming and the books are received in the pressing device at an angle.

DE 44 22 783 A1 describes a binding-in machine, in which a series of pressing devices are arranged on a rotor that is intermittently driven about a vertical axis of rotation, wherein the pressing plates are arranged quasi tangentially on the rotor circumference. The joint forming devices with the heated joint forming rails are situated on the pressing devices and moved forward together therewith. From the infeed to the delivery, the books are permanently held over the entire surface in one and the same pressing device. In this case, the joint forming rails may remain closed in an uninterrupted fashion.

The books are transported in a horizontal position with their spine pointing forward and transferred into an upright position with the aid of a loading station, namely with a loading rake with assigned guide web, in order to be subsequently transported into the opened, stationary pressing device from below by means of a loading table equipped with prism strips while being laterally supported by said loading rake and a counter rake. A loading ram in the form of a forming rail of a post-forming device subsequently presses against the fore edge cut and pushes the book block into the spine while the joint forming rails are slightly closed and the pressing plates are closed with or without pressure, namely such that both cover boards are pulled against the joint forming rails by means of the jointed center strip and end sheet. The book block and the case can thusly be aligned relative to one another while simultaneously post-forming the book.

While the books are transferred into an upright position, they are pushed over the guide web with their spine such that markings may be produced on sensitive case covers and the book form produced when the book block is cased into the case may be lost. This also applies to the lifting of the books while they are laterally supported by the two rakes. The latter is also a time-consuming process and limits the cycle rate of the binding-in machine together with the post-forming and aligning processes to be subsequently carried out while the rotor is at a standstill.

SUMMARY

The invention is based on the objective of developing a binding-in machine of the initially described type which makes it possible to reliably and flawlessly feed and align the books in the pressing devices with high cycle rates, wherein a pre-formed book form should be transferred into the pressing device gently and such that its form is largely preserved.

This objective is attained with a book gripper that laterally takes hold of the books and receives the books from an upstream transfer position, wherein said book gripper transports the respective vertically positioned book between the opened pressing plates of a pressing device in the form of a back and forward movement, as well as with an alignment table, on which the gripper deposits the book with its spine for the subsequent aligning and post-forming of the book within the pressing device. The book gripper directly transports the books between the pressing plates of the pressing device that accommodates the entire surface of the books as quickly as possible, wherein the books are gently placed onto the alignment table without pushing the books over rakes or webs. The book form according to the upstream transfer position is preserved and can be additionally processed into a high-quality product by means of the subsequent aligning and post-forming processes.

In order to form a shaft, lateral guide elements may be assigned to the alignment table such that the books are held in the vertical position after they are deposited. The alignment table is preferably situated in a depositing position, in which it is lowered referred to the height of the joint forming rails while the book is deposited thereon by the book gripper. In order to position the case joints at the height of the joint forming rails, it is advantageous if the alignment table can be raised from the depositing position into an aligning position. It is advantageous if the pressing plates are controlled into a first closed position after the book gripper is moved away in order to raise the book with the aid of the alignment table, wherein a defined guide channel with narrow guidance is provided for the book.

According to one embodiment of the inventive binding-in machine, the pressing devices with the joint forming devices situated thereon are arranged on a rotor that rotates about an axis. The rotor preferably is rotatively driven in an intermittent fashion, wherein the alignment of the books by means of the forming rail and the alignment table takes place while the rotor is at a standstill such that a relatively simple construction can be achieved.

It is advantageous if the pressing plates can be moved in a vertical plane, wherein this is achieved by arranging the axis of rotation of the rotor in a horizontal position such that it is oriented perpendicular to the pressing plates and the joint forming rails essentially extend radially referred to the axis of rotation. The feed of the books by means of the book gripper may take place while the rotor still rotates, wherein the respective pressing device is quasi moved into its transfer position from the bottom toward the top while its pressing plates are open. It is advantageous if the joint forming rails of the joint forming device arranged on the pressing device are oriented horizontally in the transfer position such that the gravitational force acts in the direction towards the book spine. The pressing device preferably is moved upward into the transfer position around the alignment table while its pressing plates are opened such that the books can already be deposited on the alignment table when the pressing device is still moved into the transfer position.

According to one embodiment of the inventive binding-in machine, the book gripper is driven such that it pivots about an axis that is oriented perpendicular to the pressing plates in order to turn and transfer the books from the upstream transfer position into the depositing position between the pressing plates.

The advantage of a defined transfer of the books in the horizontal direction, i.e., in the direction of the book height, is achieved due to the fact that the pivoting axis of the book gripper is format-adjustable parallel to itself in the horizontal direction, for example, in order to change the reference edge when the books are turned from the head or the foot to the book center or vice versa.

The advantage of a defined transfer of the books in the vertical direction, i.e., in the direction of the book width, is achieved due to the fact that the pivoting axis of the book gripper is format-adjustable parallel to itself in the vertical direction, for example, in order to change the reference edge when turning the books from the fore edge cut to the book spine or vice versa, wherein the spine shape, i.e., a straight or a curved spine shape, as well as the radius of the curvature, can also be taken into consideration.

BRIEF DESCRIPTION OF THE DRAWINGS

The characteristics of one preferred embodiment of the present invention are described below with reference to the enclosed figures, in which.

DETAILED DESCRIPTION

Figure 1:
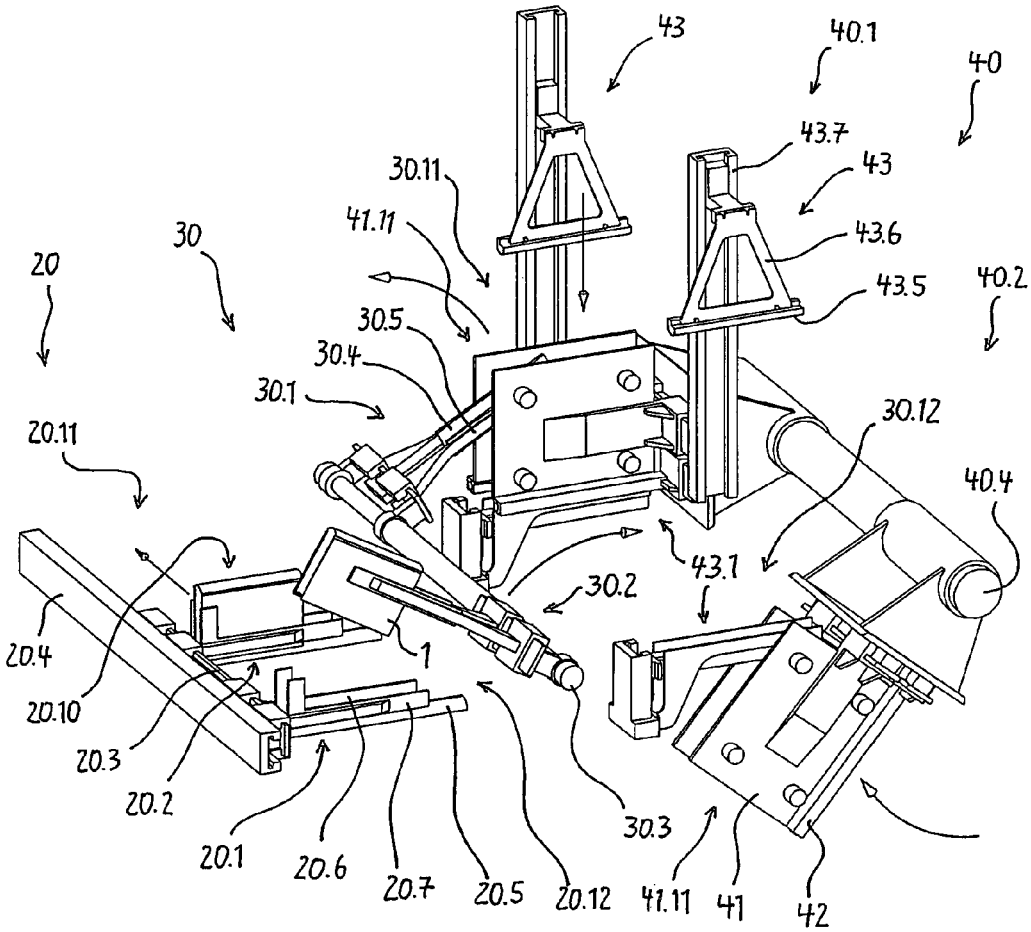
FIG. 1 is a schematic perspective representation of the infeed region of a binding-in machine with a book gripper, namely in the instant in which a book is transferred into a pressing device.

Book blocks 2 and cases 3 are connected into books 1 in a casing-in machine 10. A binding-in machine 40 is arranged downstream of the casing-in machine 10, wherein a crease-free and permanent glued connection between the end sheets of the book block 2 and the inner surfaces of the case is produced in said binding-in machine when the book 1 is pressed in. This full-surface pressing step takes place in combination with the joint forming step, in which the case joints 1*c* are formed and glued. The feed of the books 1 from the book delivery 20 of the casing-in machine 10 to the binding-in machine 40 forms the object of the present invention.

The function of the casing-in machine 10 is initially described below with reference to FIG. 3. A book block transport chain 10.1 feeds book blocks 2 to a circulation conveyor 10.3, by means of which the book blocks 2 are transported astraddle on support plates 10.4 such that they are always positioned vertically. During the vertical transport movement of the book blocks, glue is applied over the entire surface of their end sheets by means of gluing rollers 10.6 and the book blocks are subsequently connected to cases 3 supplied by a case transport unit 10.2. The thusly created books 1 may subsequently also pass through pressing rollers 10.7.

Figure 2:
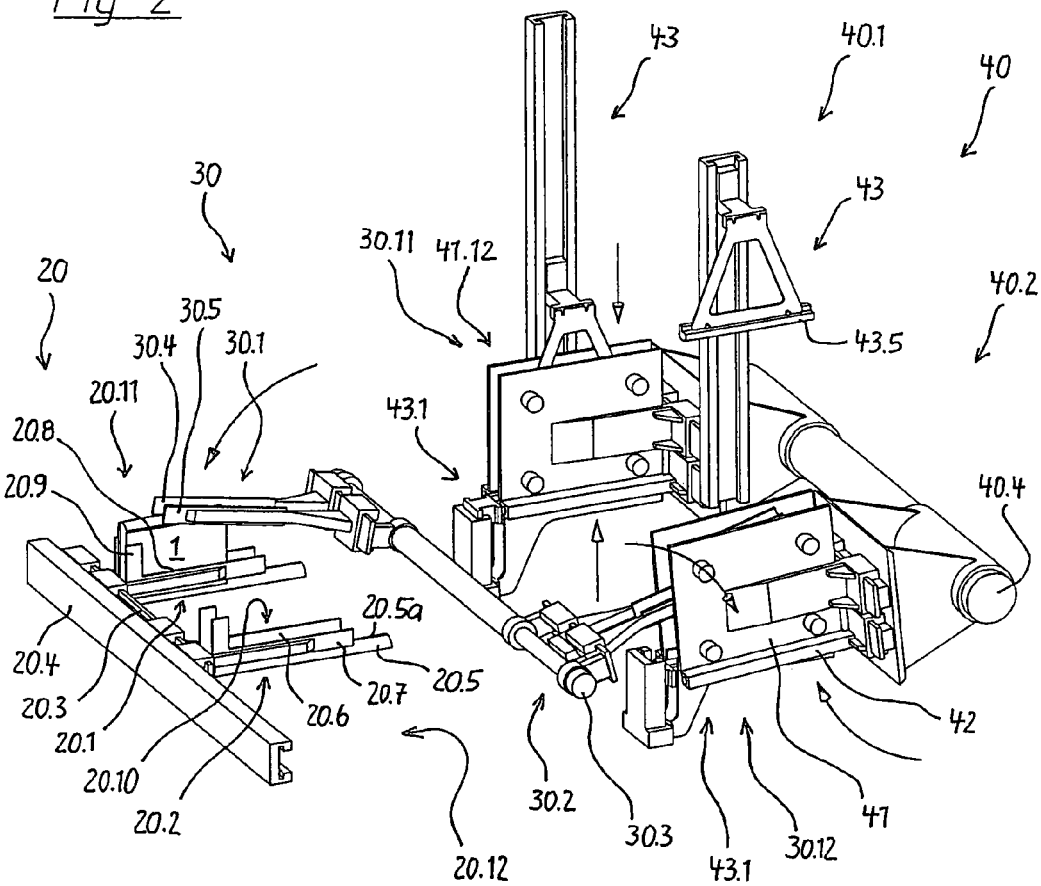
FIG. 2 is a representation according to FIG. 1 of the infeed region with a book gripper immediately before the depositing of a book.

During the additional transport, the downwardly moving books 1 reach a book delivery unit 20 that lies in the plane of motion 10.5 of the support plates 10.4, wherein the fore edge cut 1*b* of the books 1 is placed onto a stripping element 20.5 that features a through-slot 20.5*a* for guiding through the support plates 10.4. The stripping element 20.5 forms part of a book receptacle 20.1 or 20.2, by means of which the books can be transferred from the stripping position 20.10 into a delivery position 20.11 or 20.12 that is offset parallel to the plane of motion, namely while being continuously supported by said book receptacle (in this respect, see FIGS. 1 and 2), wherein the books 1 are supported on the stripping element 20.5 with their fore edge cut 1*b* during the lateral movement. In addition to the stripping element 20.5, other supporting means in the form of left and right supporting rails 20.6 and 20.7 are provided, wherein said supporting rails are closed to a narrow guiding dimension or with a slight clamping force after the book 1 is stripped off the supporting plate 10.4.

In order to divide the book flow situated in the circulation conveyor 10.3, a first and a second book receptacle 20.1 and 20.2 may alternately receive the books 1 from the stripping position 20.10 and transfer the books into left and right delivery positions 20.11 and 20.12 referred to the plane of motion 10.5. The two book receptacles 20.1 and 20.2 are arranged at a defined distance from one another on a slide 20.3 that can be moved back and forward perpendicular to the plane of motion of the supporting plates 10.4 in a guide rail 20.4 such that the second book receptacle 20.2 is moved from its right delivery position 20.12 into the stripping position 20.10 simultaneously with the delivery stroke of the first book receptacle 20.1 and vice versa.

As mentioned above, the binding-in process follows the casing-in process, wherein the books need to be fed to the binding-in machine 40 with their spine la pointing downward, and wherein the books are delivered from the casing-in machine 10 with their spine la situated on top.

The previously described book delivery 20 is situated upstream of a double book gripper 30, by means of which the books 1 can be transferred from the respective left and right delivery positions 20.11 and 20.12 (in the form of upstream transfer positions) into (from the viewpoint of the casing-in machine 10) second left and right delivery positions 30.11 and 30.12, wherein the books 1 are turned and directly deposited on an alignment table 43.1 of an aligning and post-forming station 43 of the binding-in machine 40 with their spine 1*a*.

The double book gripper 30 features a left and a right book gripper 30.1 and 30.2 for transferring the divided book flow, wherein said book grippers can be pivoted back and forward about a pivoting axis 30.3 by 180°, namely in a diametrically opposite fashion as symbolized in the figures with corresponding motion arrows. The books 1 are laterally taken hold of by a left and a right clamping jaw 30.4 and 30.5 in a region that is left exposed by the left and right supporting rails 20.6 and 20.7. For this purpose, the supporting rails 20.6 and 20.7 are realized in an L-shaped fashion and respectively feature a horizontally extending limb 20.8 that is oriented in the direction of the book height and a vertically extending limb 20.9 that is oriented in the direction of the book width.

Figure 3:
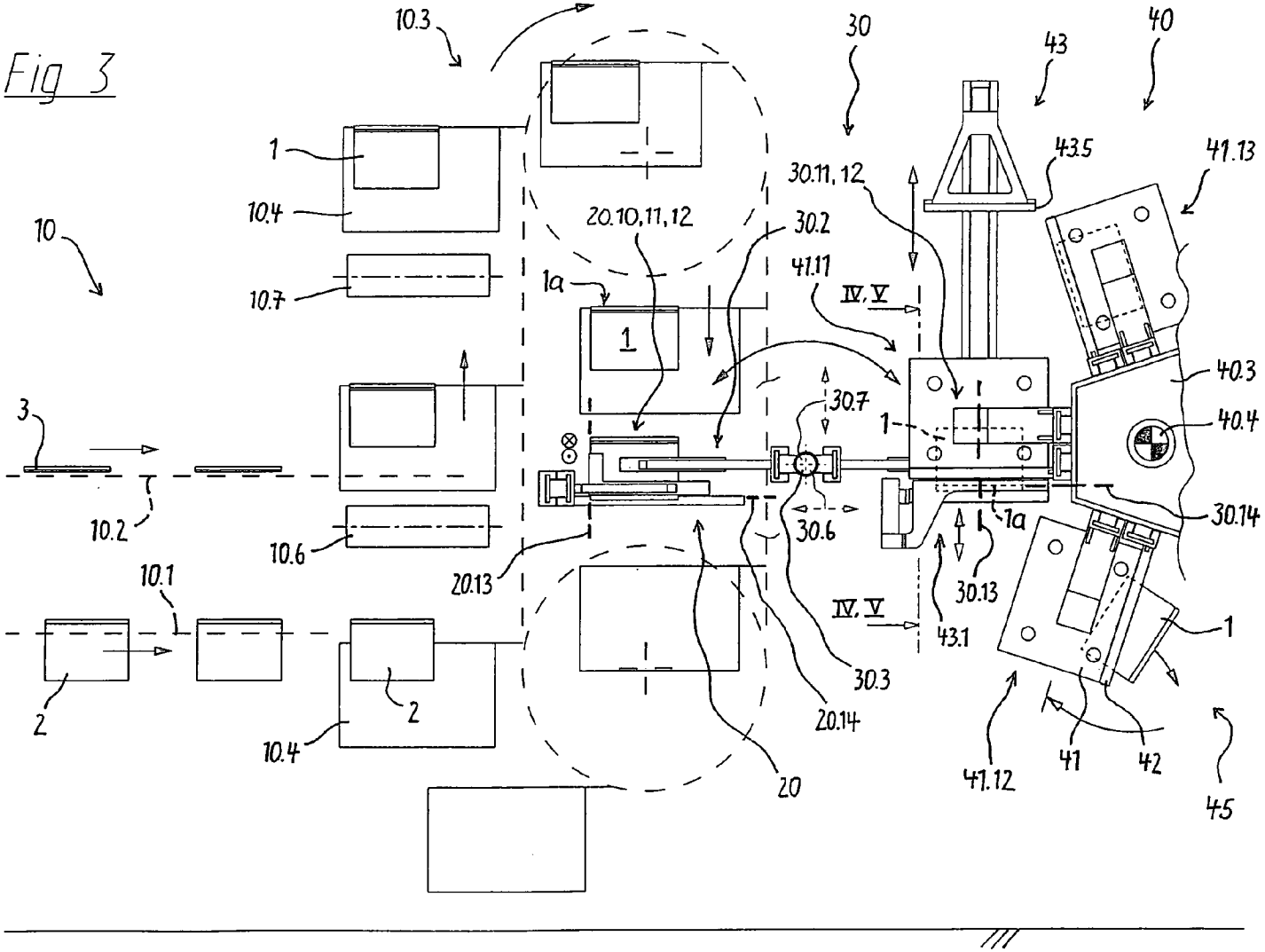
FIG. 3 is a schematic side view of a casing-in machine with book delivery, the book gripper and a section of the binding-in machine.

It is possible to deposit the books 1 on the alignment table 43.1 in a predetermined position with parallel pivot point adjustments 30.6, 30.7 of the pivoting axis 30.3 in the horizontal direction and the vertical direction—as symbolically illustrated with broken double arrows in FIG. 3.

The horizontal pivot point adjustment 30.6 makes it possible to define the position of the books in the horizontal direction, i.e., in the direction in which the book height extends. In the casing-in machine 10, the books 1 are transported astraddle on the support plates 10.4 with a foot edge 20.13 of fixed format. However, in the binding-in machine 40, a book center 30.13 of fixed format is desirable such that the books 1 are centrally clamped in the pressing devices 41. During format changes, this reference edge change can be automated in the form of a corresponding horizontal pivot point adjustment 30.6 in dependence on the respective change in the book height.

The vertical pivot point adjustment 30.7 makes it possible to define the position of the books in the vertical direction, i.e., in the direction in which the book width extends. After being positioned on the stripping element 20.5, the books 1 are delivered out of the casing-in machine 10 with the fore edge cut 1*b* as fixed reference edge 20.14. However, the books 1 need to be fed to the binding-in machine 40 with the spine 1a as fixed reference edge 30.14. During format changes, this reference edge change can be automated in the form of a corresponding vertical pivot point adjustment 30.7 in dependence on the respective change in the book width, wherein the spine shape, i.e., a straight or a curved spine shape, as well as the radius of the curvature, can also be taken into account.

As described above, the books 1 are deposited on the alignment table 43.1 with their spine 1a in the post-forming and aligning station 43. The alignment table is formed by two prism strips 43.2 that are arranged parallel to one another and support the respective book 1 on the outer edges of its book spine with plane, inclined supporting surfaces for the outer edges of the book spine, wherein the distance between the prism strips 43.2 is adjustable with respect to the book thickness.

The respective book gripper 30.1 or 30.2 directly transfers the books 1 between the pressing plates 41.1 of the pressing devices 41 that are initially controlled into a correspondingly opened open position 41.11 for this purpose and closed into a guiding position 41.12 after the book gripper 30.1 or 30.2 is pivoted away in order to form a defined guide channel, in which the books 1 to be aligned are tightly guided.

Figure 4:
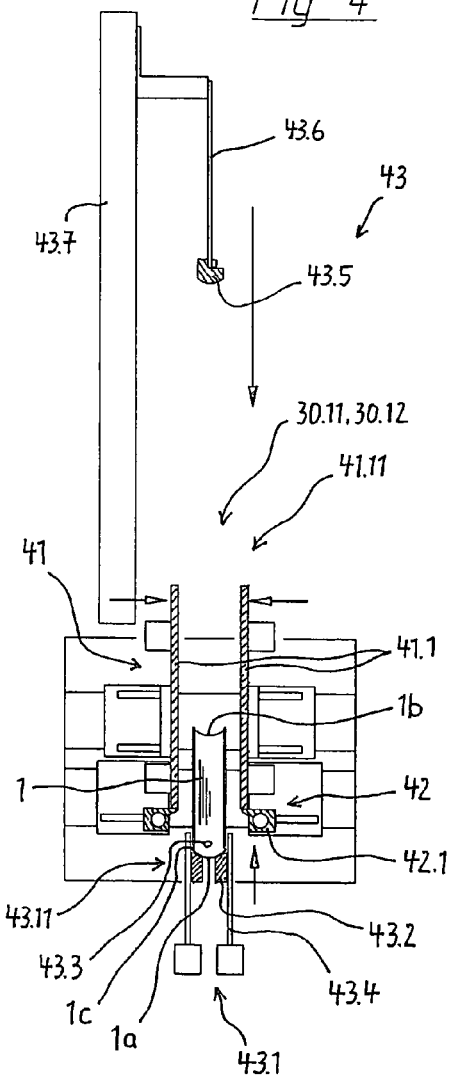
FIG. 4 is a section through the aligning and post-forming station of the binding-in machine with a book deposited therein, namely along the line of section IV in FIG. 3.
Figure 5:
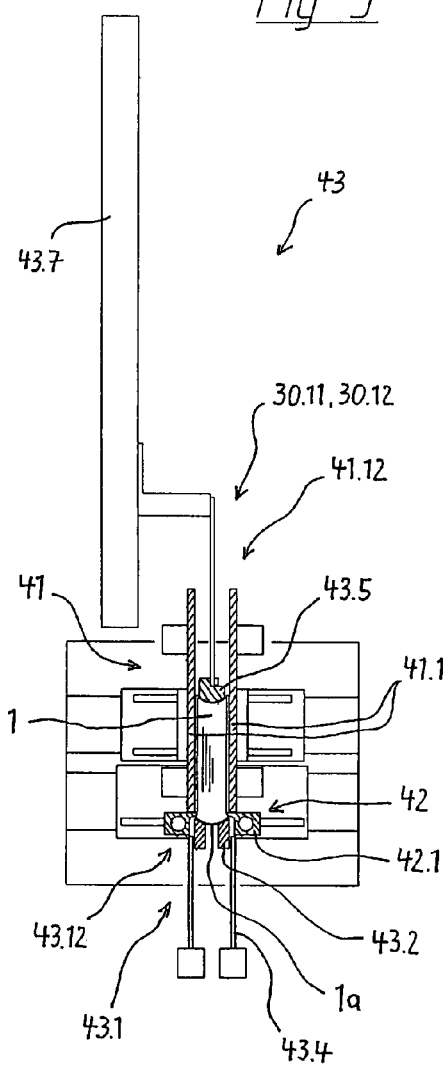
FIG. 5 is a sectional representation according to FIG. 4 through the aligning and post-forming station, namely in the instant in which a book is aligned and post-formed.

Stationary lateral guides 43.4 that can be adjusted to the book thickness are assigned to the alignment table 43.1 in order to form a shaft 43.3 that holds the books 1 in the vertical position, wherein the alignment table 43.1 is controlled into a lowered depositing position 43.11 referred to the height of the joint forming rails 42.1 while it receives a book 1 from the book gripper 30.1 or 30.2, respectively, and raised into a predefined alignment position relative to the lateral guides 43.4 in order to align and post-form the book 1, and wherein the books 1 are in the meantime supported by the pressing plates 41.1 (see FIGS. 4 and 5).

The alignment table 43.1 is only raised by a short stroke such that no unnecessary capacity restrictions are created. Alternatively, the alignment table 43.1 may be fixed in said alignment position 43.12, in which case the lateral guides 43.4 are downwardly moved out of the effective range of the pressing plates 41.1.

When the alignment table 43.1 is raised, a forming rail 43.5 that can be moved up and down in a guide rail 43.7 on a support arm 43.6 is initially lowered on the fore edge cut 1*b* of the book 1 with a slight force of pressure in order to subsequently press the book block into the spine of the case with an increased force of pressure after the joint forming rails 42.1 take hold of the case joints 1*c* and thusly post-form the book, wherein the alignment table 43.1 is, if applicable, minimally lowered. Both cases are pulled against the joint forming rails 42.1 by means of the jointed center strip and end sheet. The book block 2 and the case 3 can thusly be aligned relative to one another while simultaneously post-forming the book 1.

The binding-in machine 40 is only partially illustrated in the figures and, in order to process the divided book flow, consists of left and right binding-in machines 40.1 and 40.2 that are essentially realized identically, but intermittently driven offset in phase by 180 degrees. In these binding-in machines, a multitude of pressing devices 41 are respectively arranged on a rotor 40.3, the axis of rotation 40.4 of which is oriented perpendicular to the pressing plates 41.1 and extends horizontally such that the pressing devices 41 quasi revolve overhead. The joint forming devices 42 are also situated on the rotor and rotate together with the pressing devices 41. Their joint forming rails 42.1 essentially extend radially referred to the axis of rotation 40.4 of the rotor.

The plane of motion of the pressing devices 41 is identical to the plane of motion of the respective book gripper 30.1 or 30.2 that feeds the books 1 to the pressing devices 41. This makes it possible to feed the books 1 while the rotor 40.3 is still driven, wherein the respective pressing device 41 is quasi moved upward into the aligning and post-forming station 43 around the alignment table 43.1 while its pressing plates 41.1 are controlled into the open position 41.11.

The rotational movement of the pressing devices 41 ideally comes to a standstill when the book gripper 30.1 or 30.2 has deposited a book 1 to be processed on the alignment table 43.1 and is already pivoted back out of the effective range of the pressing plates 41.1 such that the pressing devices 41 can be controlled into their guiding position 41.12 immediately thereafter and the alignment table 43.1 carrying the book 1 can be raised into the aligning position 43.12.

After the aligning and post-forming processes are completed, the forming rail 43.5 is upwardly moved out of the pressing plates 41.1 and the pressing device 41 is controlled into its clamping position 41.13, in which the full surface of the books 1 is already subjected to a certain pressure. In addition, the heated joint forming rails 42.1 close with increased pressure in order to form the case joints 1*c*. The rotor movement may begin in the instant in which the forming rail 43.5 is lifted off the fore edge cut 1*b* of the book 1 in order to respectively advance the pressing devices 41 by one position.

During their intermittent rotation, the pressing devices 41 pass through a not-shown pressing station, in which an increased force of pressure can be externally exerted upon the pressing plates 41 while the rotor is at a standstill in order to realize the actual full-surface pressing of the books 1. Furthermore, a delivery station 45 is provided, in which the books 1 can be removed from the pressing devices 41.

The invention claimed is:

1. A binding-in machine for pressing in and joint forming books having a case, a book block with a fore edge cut and a spine, the machine including devices for aligning the book block relative to the case as well as for post-forming the rounded book block by means of a forming rail that acts upon the fore edge cut of the book block, wherein the book is supported on its spine and/or in the case joints, comprising:

a plurality of pressing devices each including a pair of opposite pressing plates the distance between which can be varied in order to exert full-surface pressure upon the sides of the book, said pressing devices being moveable into a book transfer receiving position;

a case joint forming device operatively associated with each pressing device that includes a pair of opposite heated joint forming rails the distance between which can be varied in order to form case joints on said books;

a book gripper that laterally takes hold of the books and receives the books from an upstream transfer position in which the books are positioned vertically, said book gripper transporting a respective vertically positioned book to a depositing position between the opened pressing plates of a pressing device when the pressing device is in the book transfer receiving position, said book gripper being moveable reciprocally about a pivoting axis that is oriented perpendicular to the pressing plates in order to turn and transfer the books from the upstream transfer position into the depositing position between said pressing plates; and an alignment table on which the book gripper deposits the book on its spine and on which the book is subsequently aligned and post formed within the pressing device.

2. The binding-in machine according to claim 1, wherein lateral guide elements are provided on the alignment table in order to form a shaft in which a book is deposited by the book gripper.

3. The binding-in machine according to claim 1, wherein said alignment table and book gripper are operatively associated such that the alignment table has a lowered depositing position referenced to the height of the joint forming rails when the book gripper is in its depositing position.

4. The binding-in machine according to claim 3, wherein said alignment table is vertically moveable between said lower depositing position and, with the book spine thereon, a raised, stationary aligning position.

5. The binding-in machine according to claim 4, wherein said pressing plates, gripper and alignment table are operatively associated such that after the book gripper is pivoted away the pressing plates are in a first closed position that defines a guide channel in which the book is tightly guided while the book is raised with the aid of the alignment table.

6. The binding-in machine according to claim 5 wherein the pressing devices are arranged on a rotor that rotates about an axis together with the case joint forming devices provided therewith.

7. The binding-in machine according to claim 1, wherein the pressing devices are arranged on a rotor that rotates about an axis together with the case joint forming devices provided therewith.

8. The binding-in machine according to claim 6, wherein the rotation of said rotor has an intermittent standstill condition and the rotor, alignment table, and joint forming rails are operatively associated whereby the books are aligned by the forming rail and the alignment table while the rotor is at a standstill condition.

9. The binding-in machine according to claim 7 wherein said rotor has a horizontal axis of rotation, said pressing devices are arranged on the rotor together with the joint forming devices in such a way that the axis of rotation is oriented perpendicular to the pressing plates and the joint forming rails essentially extend radially with respect to the axis of rotation.

10. The binding-in machine according to claim 8 wherein said rotor has a horizontal axis of rotation, said pressing devices are arranged on the rotor together with the joint forming devices in such a way that the axis of rotation is oriented perpendicular to the pressing plates and the joint forming rails essentially extend radially with respect to the axis of rotation.

11. The binding-in machine according to claim 9, wherein the book gripper and the rotor are operatively associated such that the pivoting book gripper turns the books while the rotor rotates, and a respective pressing device moves upward toward its transfer position with opened pressing plates.

12. The binding-in machine according to claim 10, wherein the book gripper and the rotor are operatively associated such that the pivoting book gripper turns the books while the rotor rotates and a respective pressing device moves upward toward its transfer position with opened pressing plates.

13. The binding-in machine according to claim 11, wherein said case joint forming device provided with each pressing device is oriented horizontally with its joint forming rails in the transfer position.

14. The binding-in machine according to claim 12, wherein said case joint forming device provided with each pressing device is oriented horizontally with its joint forming rails in the transfer position.

15. The binding-in machine according to claim 11, wherein said pressing device is operatively associated with the alignment table so that as a respective pressing device moves upwardly into the transfer position with opened pressing plates, the plates pass around said alignment table.

16. The binding-in machine according to claim 12, wherein said pressing device is operatively associated with the alignment table so that as a respective pressing device moves upwardly into the transfer position with opened pressing plates, the plates pass around said alignment table.

17. The binding-in machine according to claim 1, wherein said pivoting axis of the book gripper is horizontally adjustable to another, parallel pivoting axis.

18. The binding-in machine according to claim 1, wherein said pivoting axis of the book gripper is vertically adjustable to another, parallel pivoting axis.

19. The binding-in machine according to claim 17 wherein said pivoting axis of the book gripper is vertically format-adjustable parallel to itself in order to realize a defined transfer of the books in the vertical direction in which the book width extends.

* * * * *